US011371518B2

(12) United States Patent
Hsieh et al.

(10) Patent No.: US 11,371,518 B2
(45) Date of Patent: Jun. 28, 2022

(54) CEILING FAN AND FAN SET

(71) Applicant: HOTECK INC., Taichung (TW)

(72) Inventors: Lung-Fa Hsieh, Taichung (TW); Yu-Chen Hsieh, Taichung (TW)

(73) Assignee: HOTECK INC., Taichung (TW)

( * ) Notice: Subject to any disclaimer, the term of this patent is extended or adjusted under 35 U.S.C. 154(b) by 142 days.

(21) Appl. No.: 16/986,429

(22) Filed: Aug. 6, 2020

(65) Prior Publication Data

US 2022/0042520 A1 Feb. 10, 2022

(51) Int. Cl.

| | |
|---|---|
| ***F04D 25/08*** | (2006.01) |
| ***F04D 29/58*** | (2006.01) |
| ***F04D 29/18*** | (2006.01) |
| ***F04D 25/06*** | (2006.01) |
| ***F04D 29/34*** | (2006.01) |

(52) U.S. Cl.

CPC ..... *F04D 25/088* (2013.01); *F04D 25/0613* (2013.01); *F04D 29/181* (2013.01); *F04D 29/34* (2013.01); *F04D 29/584* (2013.01)

(58) Field of Classification Search

CPC .... F04D 25/088; F04D 25/0613; F04D 29/20; F04D 29/34; F04D 29/181

USPC ..... 416/208, 214 R

See application file for complete search history.

(56) References Cited

U.S. PATENT DOCUMENTS 4,053,259 A * 10/1977 Bianchi ..... F04D 29/36 416/214 R
9,133,856 B2 * 9/2015 Wang ..... F04D 29/34

FOREIGN PATENT DOCUMENTS

| | | |
|---|---|---|
| GB | 478417 | * 1/1938 |
| GB | 854690 | * 11/1960 |
| GB | 217936 | * 10/1986 |

* cited by examiner

*Primary Examiner* — Charles G Freay

(74) *Attorney, Agent, or Firm* — Li & Cai Intellectual Property (USA) Office

(57) ABSTRACT

A ceiling fan and a fan set are provided. The fan set includes an upper fixed plate, a lower fixed plate, and a plurality of fan blades. The upper fixed plate has a plurality of first through holes that are in a ring-shaped arrangement, and the lower fixed plate has a plurality of second through holes that are in a ring-shaped arrangement. The quantity of the second through holes is equal to the quantity of the first through holes, and the positions of the second through holes respectively correspond to the positions of the first through hole. Each of the fan blades has an assembly portion, a blade portion, and three fasteners. The fasteners pass through the first through holes and the second through holes such that each of the fan blades is fastened between the upper fixed plate and the lower fixed plate.

9 Claims, 6 Drawing Sheets

CEILING FAN AND FAN SET

FIELD OF THE DISCLOSURE

The present disclosure relates to a ceiling fan, and more particularly to a ceiling fan and a fan set that can be easily manufactured and for which the quantity of fan blades can be adjusted.

BACKGROUND OF THE DISCLOSURE

The specification of a conventional ceiling fan is fixed when leaving the factory, and ceiling fans of different models each have a fixed quantity of fan blades. In other words, the blade seat for each of the ceiling fans of different models is not the same. As such, different production lines are required for manufacturing the blade seat for ceiling fans of different models, which is inconvenient. Furthermore, as the quantity of fan blades that can be assembled in the blade seat of the conventional ceiling fan is fixed, users cannot adjust the quantity of the fan blades of the ceiling fan according to the environment or practical requirements.

SUMMARY OF THE DISCLOSURE

In response to the above-referenced technical inadequacies, the present disclosure provides a ceiling fan and a fan set to effectively improve on the issues associated with the conventional ceiling fans.

In one aspect, the present disclosure provides a ceiling fan, which is configured to be disposed on a ceiling. The ceiling fan includes a top cover, a rod, an external rotor motor, and a fan set. The rod has two ends. One of the two ends of the rod is connected to the top cover. The external rotor motor is disposed on another one of the two ends of the rod. The external rotor motor includes a fixed unit and a rotating unit that is assembled on the fixed unit. The fixed unit is assembled on the another one of the two ends of the rod, and the rotating unit is rotatable relative to the fixed unit. The fan set is disposed on the rotating unit of the external rotor motor. The fan set includes an upper fixed plate, a lower fixed plate, and a plurality of fan blades. The upper fixed plate is disposed on a side of the rotating unit adjacent to the rod and has a plurality of first through holes that are in a ring-shaped arrangement. The quantity of the first through holes is 3M, and M is a positive integer equal to or greater than 3. The lower fixed plate is disposed on a side of the rotating unit away from the rod and spaced apart from the upper fixed plate. The lower fixed plate has a plurality of second through holes that are in a ring-shaped arrangement. The quantity of the second through holes is equal to the quantity of the first through holes, and the positions of the second through holes respectively correspond to the positions of the first through holes. The quantity of the fan blades being N. Each of the fan blades has an assembly portion, a blade portion extending from the assembly portion, and three fasteners. N is a common factor of 3M, and is a positive integer equal to or greater than 2. The fasteners pass through the first through holes and the second through holes such that each of the fan blades is fastened between the upper fixed plate and the lower fixed plate. The blade portion of each of the fan blades is configured to generate a gas flow direction and define an air outlet side and an air inlet side that is opposite to the air outlet side according to the direction of the gas flow. Each of the fan blades is configured to be disposed between the upper fixed plate and the lower fixed plate in a direction with the air outlet side facing toward the upper fixed plate or away from the upper fixed plate.

In another aspect, the present disclosure provides a fan set, which is configured to be disposed on an external rotor motor. The fan set includes an upper fixed plate, a lower fixed plate, and a plurality of fan blades. The upper fixed plate has a plurality of first through holes that are in a ring-shaped arrangement. The quantity of the first through holes is 3M, and M is a positive integer equal to or greater than 3. The lower fixed plate spaced apart from the upper fixed plate. The lower fixed plate has a plurality of second through holes that are in a ring-shaped arrangement. The quantity of the second through holes is equal to the quantity of the first through holes, and the positions of the second through holes respectively correspond to the positions of the first through holes. The quantity of the fan blades being N. Each of the fan blades has an assembly portion, a blade portion extending from the assembly portion, and three fasteners. N is a common factor of 3M, and is a positive integer equal to or greater than 2. The fasteners pass through the first through holes and the second through holes such that each of the fan blades is fastened between the upper fixed plate and the lower fixed plate. The blade portion of each of the fan blades is configured to generate a gas flow direction and define an air outlet side and an air inlet side that is opposite to the air outlet side according to the direction of the gas flow. Each of the fan blades is configured to be disposed between the upper fixed plate and the lower fixed plate in a direction that the air outlet side faces the upper fixed plate or away from the upper fixed plate.

Therefore, in the ceiling fan and the fan set of the present disclosure, by virtue of the upper fixed plate and the lower fixed plate being spaced apart from the upper fixed plate, the fasteners pass through the first through holes and the second through holes such that each of the fan blades is fastened between the upper fixed plate and the lower fixed plate. Accordingly, a user can adjust the quantity of the fan blades of the ceiling fan according to the environment and practical requirements. Furthermore, when manufacturing the ceiling fan, only the abovementioned upper and lower fixed plates need to be manufactured to enable the production of ceiling fans of different models.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
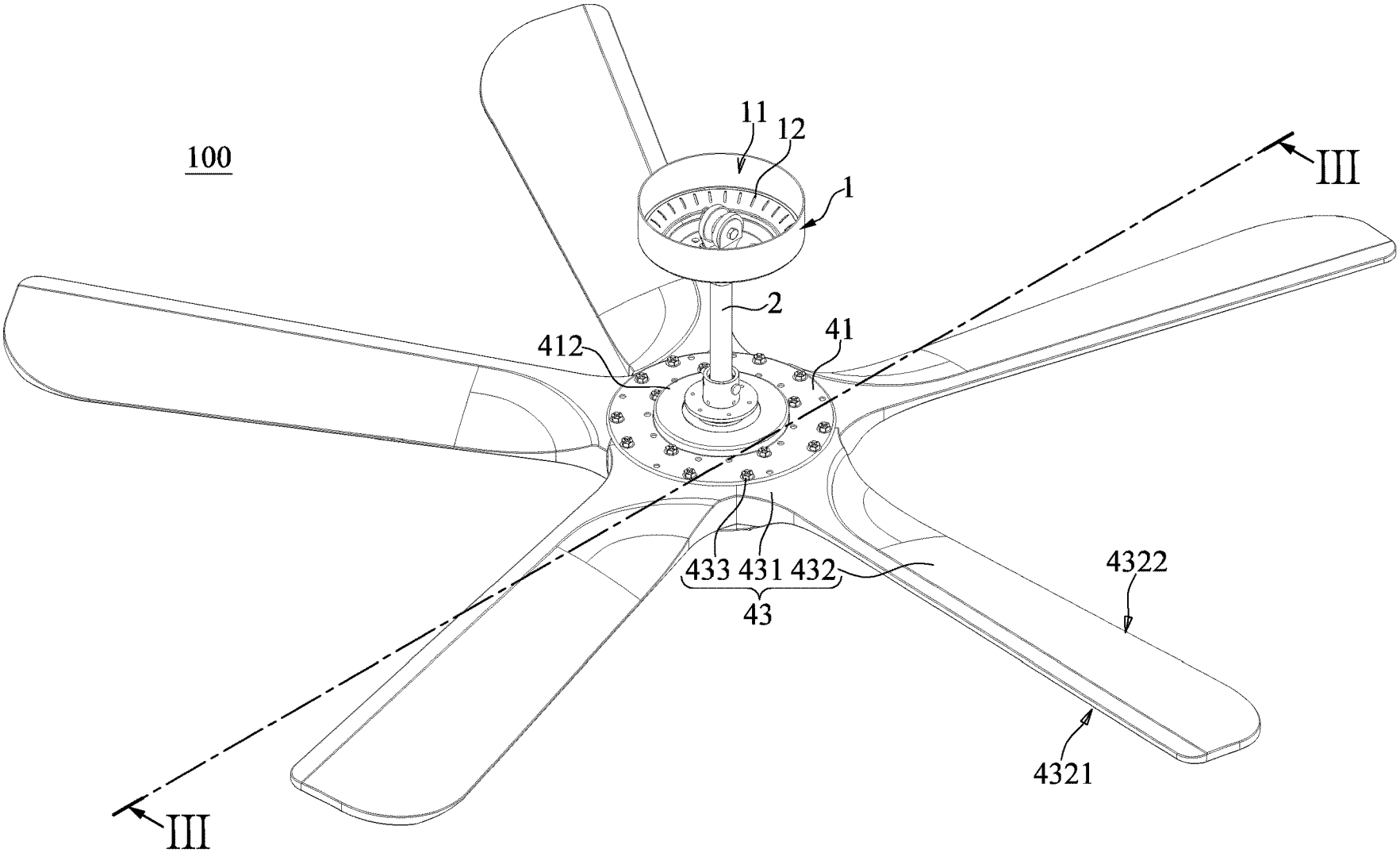
FIG. 1 is a schematic perspective view of a ceiling fan according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 4, a first embodiment of the present disclosure provides a ceiling fan 100. The ceiling fan 100 can be disposed on a ceiling W and generate a gas flow through rotation to regulate environmental conditions. In other words, any ceiling fan that cannot be disposed on the ceiling and generate the gas flow through rotation is not the ceiling fan 100 of the present disclosure. The ceiling fan 100 includes a top cover 1 disposed on the ceiling W, a rod 2 disposed on the top cover 1, an external rotor motor 3 disposed on the rod 2, and a fan set 4 that is disposed on an outer edge of the external rotor motor 3.

It should be noted that the top cover 1, the rod 2, the external rotor motor 3, and the fan set 4 in the present embodiment are jointly defined as the ceiling fan 100, but the present disclosure is not limited thereto. For example, the fan set 4 can be independently used (e.g., sold) or can be used in cooperation with other components.

Figure 2:
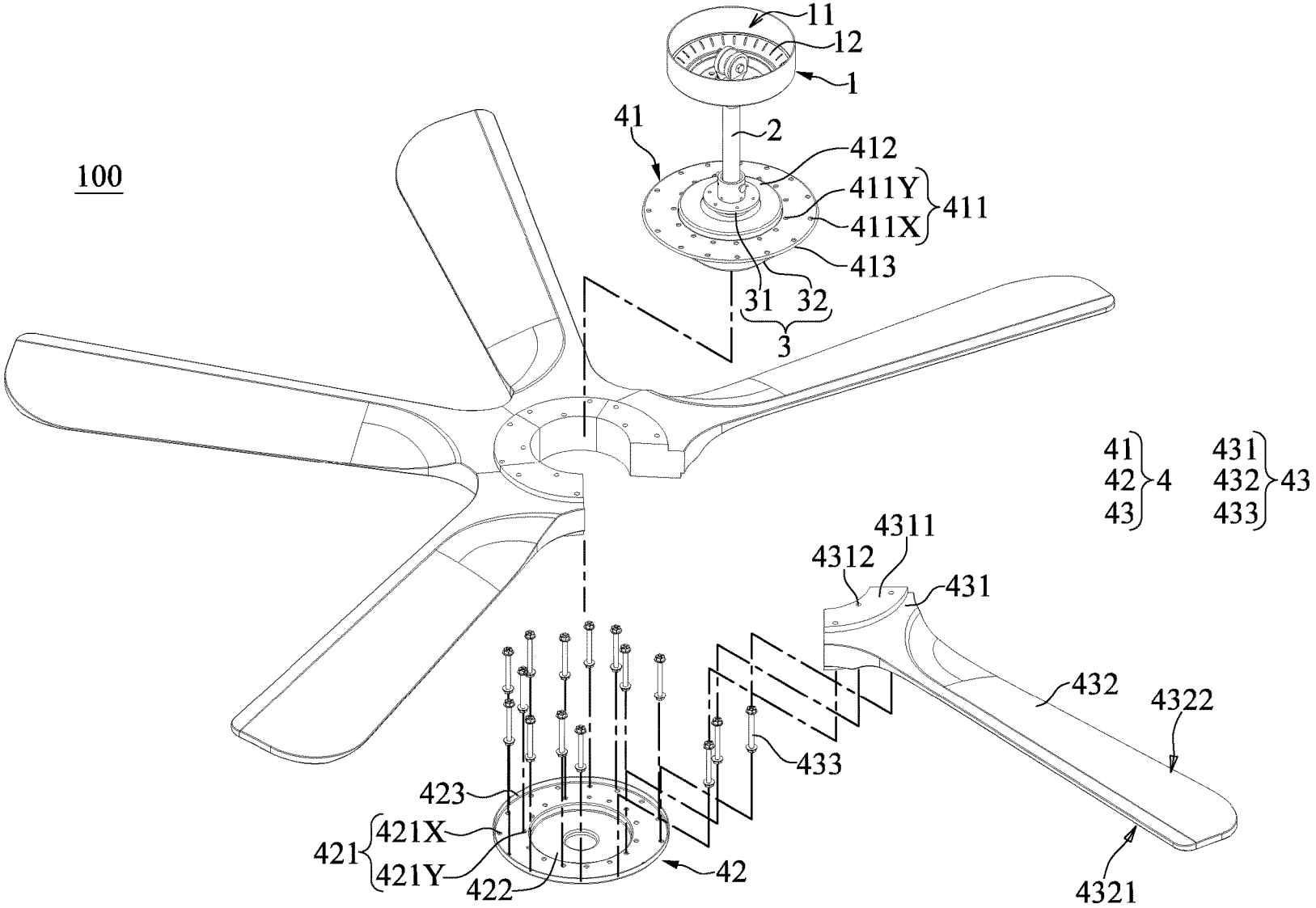
FIG. 2 is a schematic exploded view of the ceiling fan according to the first embodiment of the present disclosure.
Figure 3:
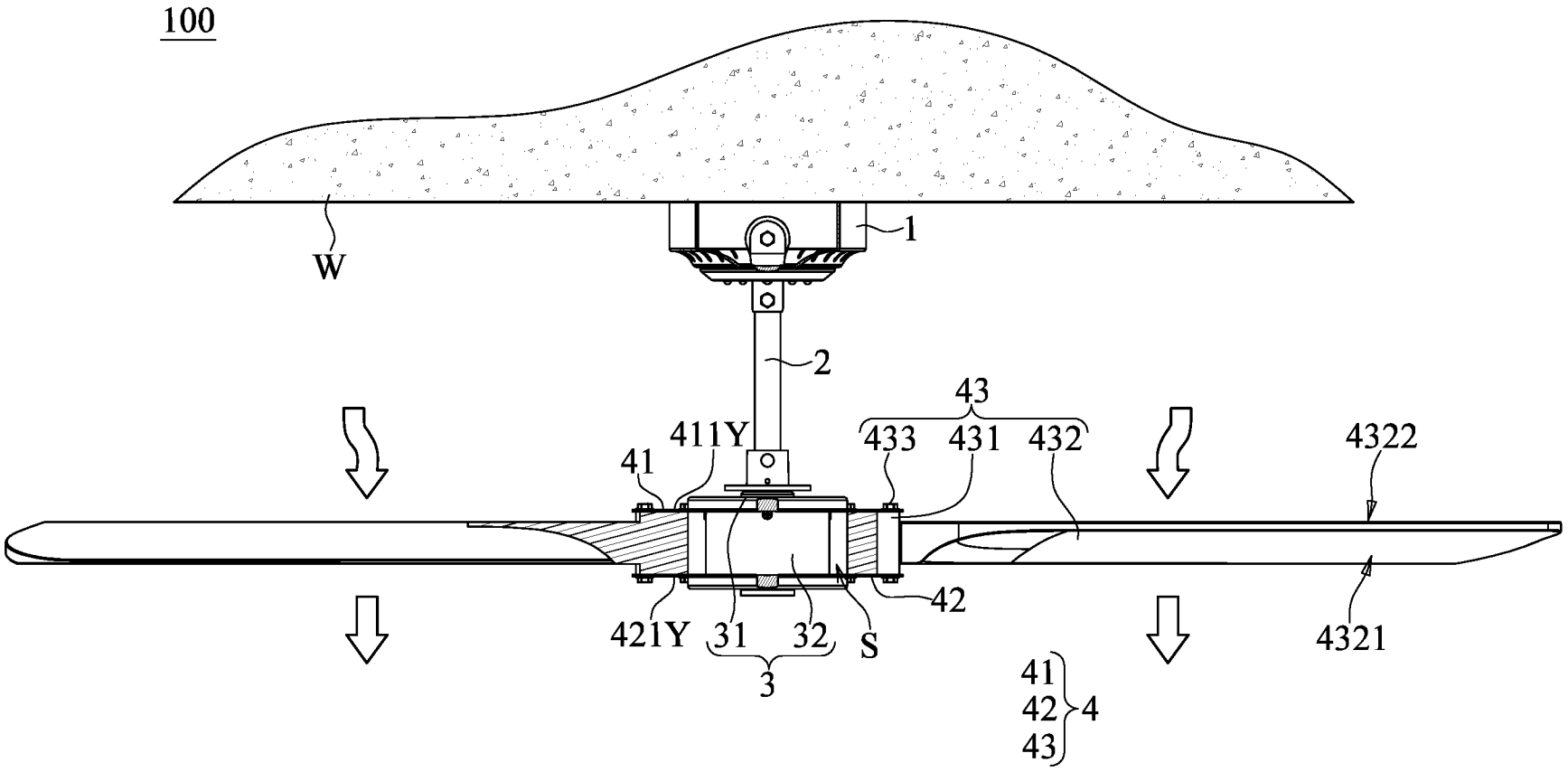
FIG. 3 is a schematic cross-sectional view taken along line III-III of FIG. 1.

Referring to FIG. 2 and FIG. 3, the top cover 1 can be disposed on the ceiling W. The top cover 1 in the present embodiment is a circular shell-like structure, and has an accommodating space 11, but the present disclosure is not limited thereto. For example, the top cover 1 may also be of other structures that can be installed on the ceiling W (e.g., a square solid structure). The top cover 1 has a plurality of perforations 12 that are in spatial communication with the accommodating space 11. One of the two ends of the rod 2 is connected to the top cover 1.

The external rotor motor 3 is disposed on another one of the two ends of the rod 2. The external rotor motor 3 includes a fixed unit 31 and a rotating unit 32 that is assembled on the fixed unit 31, and the rotating unit 32 can rotate relative to the fixed unit 31. It should be noted that a manner in which the rotating unit 32 of the external rotor motor 3 can rotate relative to the fixed unit 31 is a technology known in the art of the present disclosure, and is not the aim of the present disclosure, so the detail of the manner will not be described.

The fan set 4 is disposed on the rotating unit 32 of the external rotor motor 3. The fan set 4 includes an upper fixed plate 41 disposed on the rotating unit 32, a lower fixed plate 42 disposed on the rotating unit 32, and a plurality of fan blades 43 disposed between the upper fixed 41 and the lower fixed plate 42. Specifically, the upper fixed plate 41 and the lower fixed plate 42 are driven through the external rotation unit 32, and the fan blades 43 arranged between the upper fixed plate 41 and the lower fixed plate 42 are rotated so as to drive the surrounding air to generate airflow.

The upper fixed plate 41 is disposed on a side of the rotating unit 32 adjacent to the rod 2 and includes a plurality of first through holes 411 that are in a ring-shaped arrangement. The quantity of the first through holes 411 is 3M, and M is a positive integer equal to or greater than 3. That is to say, the quantity of the first through holes 411 is at least nine.

Specifically, the upper fixed plate 41 in the present embodiment is in a shape of a round disc, and has a first reinforced portion 412 formed on a central region thereof. The first reinforced portion 412 is in a circular shape, and a center of circle of the first reinforced portion 412 is overlapped with a center of circle of the upper fixed plate 41. Further, the first reinforced portion 412 in the present embodiment is a raised structure protruding from the upper fixed plate 41 facing toward the top cover 1, but the present disclosure is not limited thereto. For example, the first reinforced portion 412 may also be a ring structure protruding from the upper fixed plate 41 away from the top cover 1.

The first through holes 411 of the upper fixed plate 41 are disposed around the first reinforced portion 412. Specifically, the first through holes 411 are divided into a plurality of first inner holes 411Y and a plurality of first outer holes 411X that are arranged at an outer side of the first inner holes 411Y. The first inner holes 411Y are in a ring-shaped arrangement, and the first outer holes 411X are in a ring-shaped arrangement. A center of circle of the ring-shaped arrangement of the first inner holes 411Y is overlapped with a center of circle of the ring-shaped arrangement of the first outer holes 411X. In detail, the first inner holes 411Y are arranged in a ring shape and are adjacent to the first reinforcing portion 412, and the first outer holes 411X are arranged in a ring shape and are away from the first reinforcing portion 412. The first outer holes 411X surround the first inner holes 411Y, and the quantity of the first outer holes 411X and the quantity of the first inner holes 411Y each are fifteen. In other words, the quantity of the first through holes 411 is thirty, and the quantity of the first outer holes 411X is equal to the quantity of the first inner holes 411X. In addition, an outer edge of the upper fixed plate 41 has a first ring wall 413 away from the top cover 1.

The lower fixed plate 42 is disposed on a side of the rotating unit 32 away from the rod 2 and spaced apart from the upper fixed plate 41. The lower fixed plate 42 includes a plurality of second through holes 421 that are in a ring-shaped arrangement, and the quantity of the second through holes 421 is equal to the quantity of the first through holes 411. That is to say, the quantity of the second through holes 421 is at least nine.

Specifically, the lower fixed plate 42 in the present embodiment is in a shape of a round disc, and has a second reinforced portion 422 formed on a central region thereof, and the second reinforced portion 422 is in a circular shape. A center of circle of the second reinforced portion 422 is overlapped with a center of circle of the lower fixed plate 42. Further, the second reinforced portion 422 in the present embodiment is a raised structure protruding from the lower fixed plate 42 away from the upper fixed plate 41, but the present disclosure is not limited thereto. For example, the second reinforced portion 422 may also be a ring structure protruding from the lower fixed plate 42 toward the upper fixed plate 41.

The second through holes 421 of the lower fixed plate 42 are disposed around the second reinforced portion 422. Specifically, the second through holes 421 are divided into a plurality of second inner holes 412Y and a plurality of second outer holes 421X that are arranged at an outer side of the second inner holes 421Y. The second inner holes 421Y are in a ring-shaped arrangement, and the second outer holes 421X are in a ring-shaped arrangement. A center of circle of the ring-shaped arrangement of the second inner holes 421Y is overlapped with a center of circle of the ring-shaped arrangement of the second outer holes 421X. In detail, the second inner holes 421Y are arranged in a ring shape and are adjacent to the second reinforcing portion 422, and the second outer holes 421X are arranged in a ring shape and are away from the second reinforcing portion 422. The second outer holes 421X surround the second inner holes 421Y, and the quantity of the second outer holes 421X and the quantity of the second inner holes 421Y each are fifteen. In other words, the quantity of the second through holes 421 is thirty, and the quantity of the second outer holes 421X is equal to the quantity of the second inner holes 421Y. In addition, an outer edge of the lower fixed plate 42 has a second ring wall 423 toward the upper fixed plate 41.

The quantity of the fan blades 43 is N, and N is a common factor of 3M. Each of the fan blades 43 has an assembly portion 431, a blade portion 432 extending from the assembly portion 431, and three fasteners 433. Each of the fan blades 43 is configured to be disposed between the upper fixed plate 41 and the lower fixed plate 42 through the assembly portion 431, and the fasteners 433 pass through the first through holes 411 and the second through holes 421 such that each of the fan blades 43 is fixed. That is to say, the quantity of the fan blades 43 is a common factor of the quantity of the first through holes 411 or a common factor of the quantity of the second through holes 421, and is equal to or no less than 2. For example, while the quantity of the first through holes 411 in the present embodiment is thirty, the quantity of the fan blades 43 may be two, three, or five. In the present embodiment, for the purposes of description, the quantity of the fan blades 43 is five. In addition, the quantity of the fasteners 433 is three times the quantity of the fan blades 43. In other words, each of the fan blades 43 has three fasteners 433.

The assembly portion 431 of each of the fan blades 43 has a plurality of fixing holes 4312 that correspond in position to the first through holes 411 and the second through holes 421. The fixing holes 4312 can allow the fasteners 433 to pass through so as to fasten each of the fan blades 43 between the upper fixed plate 41 and the lower fixed plate 42. Further, when each of the assembly portions 431 is fixed between the upper fixed plate 41 and the lower fixed plate 42, each of the assembly portions 431 and an outer edge of the rotating unit 32 are spaced apart from each other by a predetermined distance (i.e., each of the assembly portions 431 and the rotating unit 32 are not in contact), so that the ceiling fan 100 has a heat-dissipating space S that is formed between the assembly portions 431 of the fan blades 43 and the rotating unit 32.

Preferably, the assembly portion 431 of each of the fan blades 43 has two protruding portions 4311 that are respectively arranged on two sides thereof toward the upper fixed plate 41 and the lower fixed plate 42. The two protruding portions 4311 of each of the assembly portions 431 of the fan blades 43 are configured to abut against the first ring wall 413 and the second ring wall 423 so as to prevent each of the fan blades 43 from being driven by the upper fixed plate 41 and the lower fixed plate 42 to move away from the center of the circle of the upper fixed plate 41 and the lower fixed plate 42.

Figure 4:
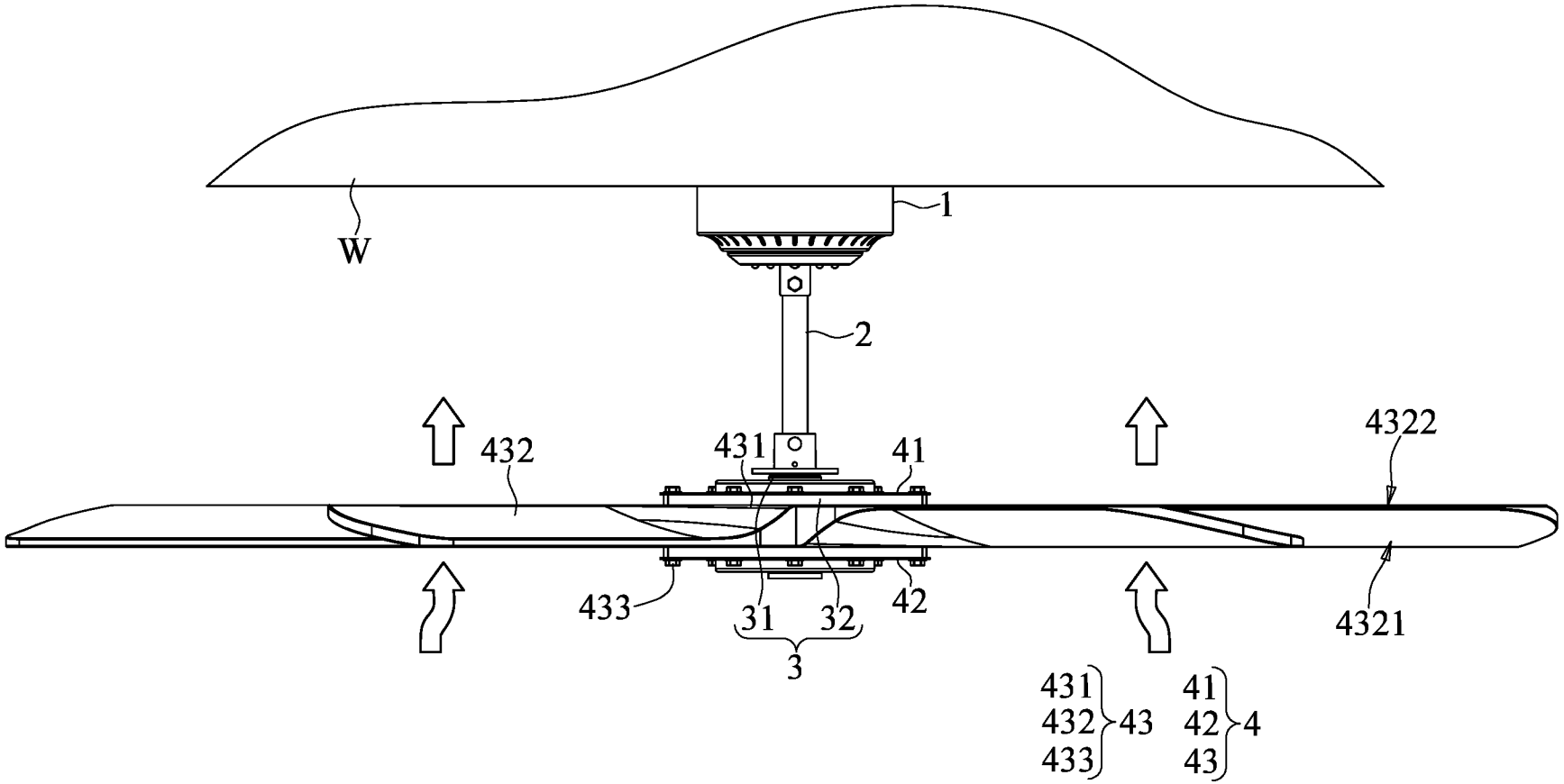
FIG. 4 is a schematic assembled perspective view of an air outlet side of a plurality of fan blades of the ceiling fan according to the first embodiment of the present disclosure facing toward the ceiling.

In addition, the blade portion 432 of each of the fan blades 43 is configured to generate a gas flow direction and define an air outlet side 4321 and an air inlet side 4322 that is opposite to the air outlet side 4321 according to a direction of the flow. Each of the fan blades 43 is configured to be disposed between the upper fixed plate 41 and the lower fixed plate 42 in a direction with the air outlet side 4321 facing toward the upper fixed plate 41 or away from the upper fixed plate 41. In other words, the blade portions 432 can be arranged between the upper fixed plate 41 and the lower fixed plate 42 with the air inlet side 4322 of the blade portions 432 uniformly facing toward the ceiling W (as shown in FIG. 3), or the air inlet side 4322 of the blade portions 432 facing away from the ceiling W (as shown in FIG. 4). Accordingly, by changing the position of the air inlet side 4322 of the fan blades 43, the gas flow direction generated by the ceiling fan 100 is adjusted.

Second Embodiment

Figure 5:
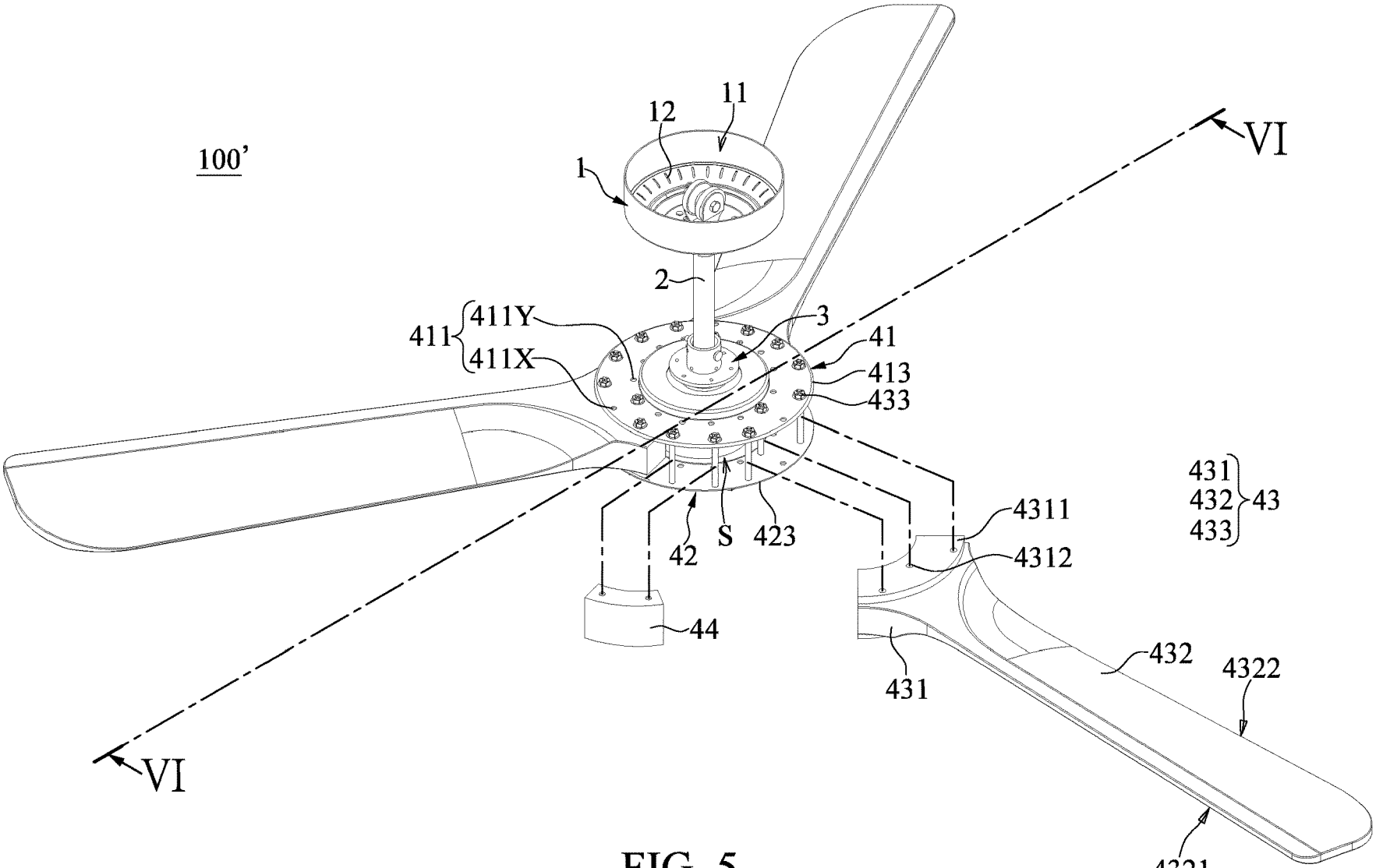
FIG. 5 is a schematic partial exploded view of a ceiling fan according to a second embodiment of the present disclosure.
Figure 6:
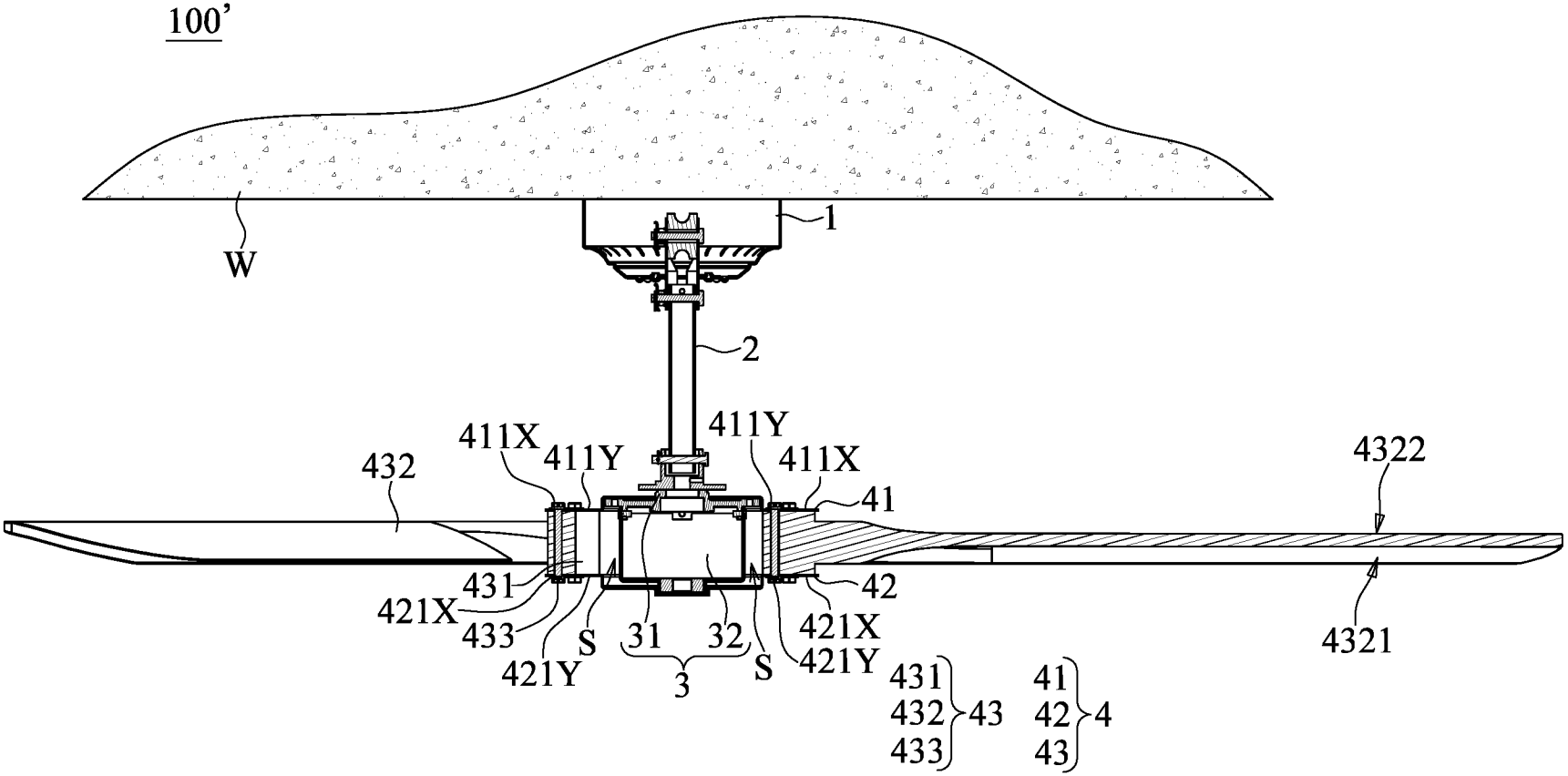
FIG. 6 is a schematic cross-sectional view taken along line VI-VI of FIG. 5.

Referring to FIG. 5 and FIG. 6, a second embodiment of the present disclosure provides a ceiling fan 100' that is similar to the first embodiment. Therefore, similarities will not be repeated herein. The difference between the second embodiment of the present disclosure and the first embodiment is that the quantity of fan blades 43 of the ceiling fan 100' in the present embodiment is three.

The fan set 4 further includes a plurality of decorative plates 44 respectively disposed between the assembly portions 431 of two of the fan blades 43 adjacent to each other. The decorative plates 44 and the assembly portions 431 of the fan blades 43 are arranged between the upper fixed plate 41 and the lower fixed plate 42, so that only a part of the first through holes 411 and a part of the second through holes 421 are in spatial communication with the heat-dissipating space S (as shown in FIG. 6).

Specifically, a cross-sectional view of each of the decorative plates 44 in the present embodiment is in an inverted L-shape. Any one of the decorative plates 44 is fastened between two of the assembly portions 431 of two of the fan blades 43 adjacent to each other by using a fixed unit to pass through the first outer holes 411X and the second outer holes 421X. When the fan blades 43 are fixed between the upper fixed plate 41 and the lower fixed plate 42, only the part of the first through holes 411 and the part of the second through holes 421 are in spatial communication with the heat-dissipating space S, and the assembly portions 431 can baffle a part of the first outer holes 411X, a part of the second outer holes 421X, a part of the first inner holes 411Y, and a part of the second inner holes 421Y. That is to say, another part of the first outer holes 411X, another part of the first inner holes 411Y, another part of the second outer holes 421X, and another part of the second inner holes 421Y are not baffled by the assembly portions 431, and are in spatial communication with the heat-dissipating space S. Accordingly, the heat energy generated by the external rotor motor 3 can be dissipated by the heat-dissipating space S, as well as the part of the first outer holes 411X, the part of the first inner holes 411Y, the part of the second outer holes 421X, and the part of the second inner holes 421Y which are not baffled by the assembly portions 431.

In conclusion, in the ceiling fan 100 and the fan set 4 of the present disclosure, by virtue of the upper fixed plate 41 and the lower fixed plate 42 being spaced apart from the upper fixed plate 41, the fan blades 43 can be disposed between the upper fixed plate 41 and the lower fixed plate 42. In addition, the fasteners 433 pass through the upper fixed plate 41, the fan blades 43, and the lower fixed plate 42 such that each of the fan blades 43 is fastened between the upper fixed plate 41 and the lower fixed plate 42. Accordingly, a user can adjust the quantity of the fan blades 43 of the ceiling fan 100 according to the environment and practical requirements. Furthermore, when manufacturing ceiling fans 100, only the upper fixed plate 41 and the lower fixed plates 42 need to be manufactured to enable the production of ceiling fans 100 of different models.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A ceiling fan for being disposed on a ceiling, the ceiling fan comprising:

a top cover;

a rod having two ends, wherein one of the two ends of the rod is connected to the top cover;

an external rotor motor disposed on another one of the two ends of the rod, wherein the external rotor motor includes a fixed unit and a rotating unit that is assembled on the fixed unit, and wherein the fixed unit is assembled on the another one of the two ends of the rod, and the rotating unit is rotatable relative to the fixed unit; and a fan set disposed on the rotating unit of the external rotor motor, wherein the fan set includes:

an upper plate disposed on a side of the rotating unit adjacent to the rod and having a plurality of first through holes that are in a ring-shaped arrangement, wherein the quantity of the first through holes is 3M, and M is a positive integer equal to or greater than 3;

a lower plate disposed on a side of the rotating unit away from the rod and spaced apart from the upper plate, wherein the lower plate has a plurality of second through holes that are in a ring-shaped arrangement, and wherein the quantity of the second through holes is equal to the quantity of the first through holes, and the positions of the second through holes respectively correspond to the positions of the first through holes; and a plurality of fan blades, the quantity of the fan blades being N, wherein each of the fan blades has an assembly portion, a blade portion extending from the assembly portion, and three fasteners, wherein N is a common factor of 3M, and is a positive integer equal to or greater than 2, and wherein the fasteners pass through the first through holes and the second through holes such that each of the fan blades is fastened between the upper plate and the lower plate;

wherein the blade portion of each of the fan blades is configured to generate a gas flow direction and define an air outlet side and an air inlet side that is opposite to the air outlet side according to the direction of the gas flow, and wherein each of the fan blades is configured to be disposed between the upper plate and the lower plate in a direction with the air outlet side facing toward the upper plate or away from the upper plate;

wherein the first through holes of the upper plate are divided into a plurality of first inner holes and a plurality of first outer holes that are arranged at an outer side of the first inner holes, wherein the first inner holes are in a ring-shaped arrangement, and the first outer holes are in a ring-shaped arrangement, wherein a center of circle of the ring-shaped arrangement of the first inner holes is overlapped with a center of circle of the ring-shaped arrangement of the first outer holes, wherein the second through holes of the lower plate are divided into a plurality of second inner holes and a plurality of second outer holes that are arranged at an outer side of the second inner holes, wherein the second inner holes are in a ring-shaped arrangement, and the second outer holes are in a ring-shaped arrangement, and wherein a center of circle of the ring-shaped arrangement of the second inner holes is overlapped with a center of circle of the ring-shaped arrangement of the second outer holes.

2. The ceiling fan according to claim 1, wherein the assembly portion of each of the fan blades is not in direct contact with an outer edge of the rotating unit, so that a heat-dissipating space is formed between the assembly portion of each of the fan blades and the rotating unit, and wherein a part of the first through holes and a part of the second through holes are in spatial communication with the heat-dissipating space.

3. The ceiling fan according to claim 2, wherein the fan set includes a plurality of decorative plates respectively disposed between the assembly portions of two of the fan blades adjacent to each other, wherein the decorative plates and the assembly portions of the fan blades are arranged between the upper plate and the lower plate so that only the part of the first through holes and the part of the second through holes are in spatial communication with the heat-dissipating space.

4. The ceiling fan according to claim 1, wherein the upper plate is in a shape of a round disc, and has a first reinforced portion formed on a central region thereof, wherein the first reinforced portion is in a circular shape, and a center of circle of the first reinforced portion is overlapped with a center of circle of the upper plate, wherein the lower plate is in a shape of a round disc, and has a second reinforced portion formed on a central region thereof, and the second reinforced portion is in a circular shape, and wherein a center of circle of the second reinforced portion is overlapped with a center of circle of the lower plate.

5. The ceiling fan according to claim 1, wherein an outer edge of the upper plate has a first ring wall, and an outer edge of the lower plate has a second ring wall, wherein the assembly portion of each of the fan blades has two protruding portions that are respectively arranged on two sides thereof toward the upper plate and the lower plate, and wherein the two protruding portions of each of the assembly portions of the fan blades are configured to abut against the first ring wall and the second ring wall.

6. A fan set for being disposed on an external rotor motor, the fan set comprising:

an upper plate having a plurality of first through holes that are in a ring-shaped arrangement, wherein the quantity of the first through holes is 3M, and M is a positive integer equal to or greater than 3;

a lower plate spaced apart from the upper plate, wherein the lower plate has a plurality of second through holes that are in a ring-shaped arrangement, and wherein the quantity of the second through holes is equal to the quantity of the first through holes, and the positions of the second through holes respectively correspond to the positions of the first through holes; and a plurality of fan blades, the quantity of the fan blades being N, wherein each of the fan blades has an assembly portion, a blade portion extending from the assembly portion, and three fasteners, wherein N is a common factor of 3M, and is a positive integer equal to or greater than 3, and wherein the fasteners pass through the first through holes and the second through holes such that each of the fan blades is fastened between the upper plate and the lower plate;

wherein the blade portion of each of the fan blades is configured to generate a gas flow direction and define an air outlet side and an air inlet side that is opposite to the air outlet side according to the direction of the gas flow, and wherein each of the fan blades is configured to be disposed between the upper plate and the lower plate in a direction with the air outlet side facing toward the upper plate or away from the upper plate;

wherein the assembly portion of each of the fan blades is not in direct contact with an outer edge of the rotating unit, so that a heat-dissipating space is formed between the assembly portion of each of the fan blades and the rotating unit, and wherein a part of the first through holes and a part of the second through holes are in spatial communication with the heat-dissipating space.

7. The fan set according to claim 6, wherein the first through holes of the upper plate are divided into a plurality of first inner holes and a plurality of first outer holes that are arranged at an outer side of the first inner holes, wherein the first inner holes are in a ring-shaped arrangement, and the first outer holes are in a ring-shaped arrangement, wherein a center of circle of the ring-shaped arrangement of the first inner holes is overlapped with a center of circle of the ring-shaped arrangement of the first outer holes, wherein the second through holes of the lower plate are divided into a plurality of second inner holes and a plurality of second outer holes that are arranged at an outer side of the second inner holes, wherein the second inner holes are in a ring-shaped arrangement, and the second outer holes are in a ring-shaped arrangement, and wherein a center of circle of the ring-shaped arrangement of the second inner holes is overlapped with a center of circle of the ring-shaped arrangement of the second outer holes.

8. The fan set according to claim 6, wherein the fan set includes a plurality of decorative plates respectively disposed between the assembly portions of two of the fan blades adjacent to each other, wherein the decorative plates and the assembly portions of the fan blades are arranged between the upper plate and the lower plate so that only the part of the first through holes and the part of the second through holes are in spatial communication with the heat-dissipating space.

9. A fan set for being disposed on an external rotor motor, the fan set comprising:

an upper plate having a plurality of first through holes that are in a ring-shaped arrangement, wherein the quantity of the first through holes is 3M, and M is a positive integer equal to or greater than 3;

a lower plate spaced apart from the upper plate, wherein the lower plate has a plurality of second through holes that are in a ring-shaped arrangement, and wherein the quantity of the second through holes is equal to the quantity of the first through holes, and the positions of the second through holes respectively correspond to the positions of the first through holes; and a plurality of fan blades, the quantity of the fan blades being N, wherein each of the fan blades has an assembly portion, a blade portion extending from the assembly portion, and three fasteners, wherein N is a common factor of 3M, and is a positive integer equal to or greater than 3, and wherein the fasteners pass through the first through holes and the second through holes such that each of the fan blades is fastened between the upper plate and the lower plate;

wherein the blade portion of each of the fan blades is configured to generate a gas flow direction and define an air outlet side and an air inlet side that is opposite to the air outlet side according to the direction of the gas flow, and wherein each of the fan blades is configured to be disposed between the upper plate and the lower plate in a direction with the air outlet side facing toward the upper plate or away from the upper plate;

wherein an outer edge of the upper plate has a first ring wall, and an outer edge of the lower plate has a second ring wall, wherein the assembly portion of each of the fan blades has two protruding portions that are respectively arranged on two sides thereof toward the upper plate and the lower plate, and wherein the two protruding portions of each of the assembly portions of the fan blades are configured to abut against the first ring wall and the second ring wall.

* * * * *